US007721596B2

(12) United States Patent
Rogers et al.

(10) Patent No.: US 7,721,596 B2
(45) Date of Patent: May 25, 2010

(54) APPARATUS AND METHOD TO MONITOR SLURRIES FOR WASTE RE-INJECTION

(75) Inventors: Brian Rogers, Houston, TX (US); Andrea Alba, Houston, TX (US); Shrinivas Peri, Sugar Land, TX (US); Lingo Chang, Missouri City, TX (US); Shannon Stocks, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 11/738,815

(22) Filed: Apr. 23, 2007

(65) Prior Publication Data

US 2007/0186625 A1 Aug. 16, 2007

Related U.S. Application Data

(62) Division of application No. 11/409,831, filed on Apr. 24, 2006.

(60) Provisional application No. 60/703,672, filed on Jul. 29, 2005.

(51) Int. Cl.
*E21B 47/12* (2006.01)

(52) U.S. Cl. ..... 73/152.02

(58) Field of Classification Search ..... 73/152.05, 73/152.02

See application file for complete search history.

(56) References Cited

U.S. PATENT DOCUMENTS

| | | | | |
|---|---|---|---|---|
| 4,526,584 | A | 7/1985 | Funk | |
| 4,557,142 | A | 12/1985 | Hensley et al. | |
| 6,045,070 | A | 4/2000 | Davenport | |
| 7,318,013 | B2 * | 1/2008 | Guo et al. | 703/2 |
| 7,478,020 | B2 * | 1/2009 | Guo et al. | 703/2 |
| 2002/0033278 | A1 | 3/2002 | Reddoch | |
| 2005/0145019 | A1 | 7/2005 | Matsiev et al. | |
| 2005/0262944 | A1 | 12/2005 | Bennett et al. | |
| 2006/0166836 | A1 | 7/2006 | Pena et al. | |
| 2007/0051539 | A1 * | 3/2007 | Blaschke et al. | 175/66 |

FOREIGN PATENT DOCUMENTS

| | | | |
|---|---|---|---|
| GB | 2327442 A | * | 1/1999 |
| GB | 2 401 944 A | | 11/2004 |

OTHER PUBLICATIONS

"Gidatec Cuttings Reinjection", printed Jul. 14, 2005 from http://www.gidatec.co.uk/Cuttings.htm.*

(Continued)

*Primary Examiner*—John Fitzgerald
(74) *Attorney, Agent, or Firm*—Osha • Liang LLP

(57) ABSTRACT

A method to inject a slurry into a subterranean formation includes measuring characteristic data from a well in communication with the subterranean formation, estimating downhole properties of the slurry using the measured characteristic data, measuring surface properties of the slurry with a measurement apparatus, determining optimal surface properties for the slurry from the estimated downhole properties, comparing the measured surface properties with the determined optimal surface properties, modifying the slurry until the measured surface properties are within tolerance values of the determined optimal surface properties, and injecting the modified slurry into the subterranean formation through the well.

7 Claims, 7 Drawing Sheets

OTHER PUBLICATIONS

U.S. Office Action with references cited by Examiner issued in corresponding U.S. Appl. No. 11/409,831; Dated Apr. 27, 2007; 9 pages.
"Advanced Cuttings Transport Study"; Stefan Miska, et al.; Final Technical; The University of Tulsa; DOE Award No. DE-FG26-99BC15178; Reporting Period Jul. 14, 1999-Jul. 14, 2003; Date of Issue: Sep. 30, 2004; 31 pages.
PCT Notification of Transmittal of the Int'l Search Report and the Written Opinion; Int'l Search Report and Written Opinion issued in corresponding PCT Application No. PCT/US2006/029516; Dated Dec. 5, 2006; 13 pages.
SPE 93781; Q. Guo, et al; "Managing Risks and Uncertainties in Drill Cuttings Re-Injection in Challenging Environments—Field Experience from Sakhalin Island"; Dated Mar. 9, 2005; 8 pages.
IADC/SPE 87972; Q. Guo, et al; "Increased Assurance of Drill Cuttings Re-Injection—Challenges, Recent Advances and Case Studies"; Dated Sep. 14, 2004; 8 pages.
Office Action in Eurasian Application No. 200800483 and English translation thereof, dated Aug. 7, 2008 (3 pages).

* cited by examiner

APPARATUS AND METHOD TO MONITOR SLURRIES FOR WASTE RE-INJECTION

CROSS-REFERENCE TO RELATED APPLICATIONS

The present application is a Divisional Application of U.S. application Ser. No. 11/409,831, filed on Apr. 24, 2006, which claims priority to U.S. Provisional Patent Application Ser. No. 60/703,672, filed on Jul. 29, 2005, hereby incorporated by reference in its entirety.

BACKGROUND

When drilling in earth formations, various waste materials including drilling cuttings (i.e., pieces of a formation dislodged by the cutting action of teeth on a drill bit) are produced. Often, in circumstances where surface storage and disposal resources are limited, these waste products may be re-injected into the formation through a cuttings re-injection (CRI) operation. While the term "cuttings re-injection" is used to describe the operation, it should be understood by one of ordinary skill in the art that the term is used generically to describe any process whereby drilling waste including, but not limited to, drill cuttings, produced sands, water, scale, and other byproducts, are reintroduced into the formation using methods and apparatus described herein.

Typically, a CRI operation involves the collection and transportation of cuttings from solid control equipment on a rig to a slurrification unit. The slurrification unit subsequently grinds the cuttings (as needed) into small particles in the presence of a fluid to create a slurry. The slurry is then transferred to a slurry holding tank for conditioning. The conditioning process affects the rheology of the slurry, yielding a "conditioned slurry." The conditioned slurry is pumped into a disposal formation by creating fractures under high pressure. Typically, the conditioned slurry may be delivered to the disposal formation through a casing annulus or a tubular system to a dedicated disposal wellbore but, in circumstances where such a wellbore is unavailable, the slurry may be delivered to a disposal section of a producing wellbore. The conditioned slurry is often injected intermittently in batches into the disposal formation. The batch process may involve injecting roughly the same volumes of conditioned slurry and then waiting for a period of time (e.g., shut-in time) after each injection. Each batch injection may last from a few hours to several days or even longer, depending upon the batch volume and the injection rate.

The batch processing (i.e., injecting conditioned slurry into the disposal formation and then waiting for a period of time after the injection) allows the fractures to close and dissipate, to a certain extent, the build-up of pressure in the disposal formation. However, the pressure in the disposal formation typically increases due to the presence of the injected solids (i.e., the solids present in the drill cuttings slurry), thereby promoting new fracture creation during subsequent batch injections. The new fractures are typically not aligned with the azimuths of previous existing fractures.

Release of waste into the environment must be avoided and waste containment must be assured to satisfy stringent governmental regulations. Important containment factors considered during the course of the operations include the following: the location of the injected waste and the mechanisms for storage; the capacity of an injection wellbore or annulus; whether injection should continue in the current zone or in a different zone; whether another disposal wellbore should be drilled; the required operating parameters necessary for proper waste containment; and the operational slurry design parameters necessary for solids suspension during slurry transport.

As many of the rigs used to drill oil and/or gas wells currently enjoy much smaller footprints than oil and/or gas wells of the past, the desired footprint for CRI operations has been reduced as well. As the CRI operation space has decreased, the need has arisen for space allocated to various pieces of equipment and systems to also decrease. Further, the decrease in available space and time spent preparing the site for CRI has accentuated the need for decreasing the footprint and preparation time for monitoring, as well as other associated equipment.

At locations where petroleum products are being recovered, refined or processed, a number of flammable gases may be present, including mixtures of oxygen, methane, ethane, propane, hydrogen sulfide and others. Standardized classifications for various types of hazardous locations have been adopted and assigned by regulatory agencies according to the nature and type of hazard that is generally present or that may occasionally be present.

Because electrical components, by their nature, may generate heat and sparks sufficient to ignite a flammable gas or other flammable mixture under even normal operating conditions, such components must be carefully designed, selected and installed when used in an area that is classified as hazardous. More specifically, the components must exceed certain minimum standards as to such characteristics as power consumption, operating temperature, current and voltage requirements, and energy storage capabilities. These standards are also established by regulatory authorities and vary depending upon the particular hazardous environment.

SUMMARY OF INVENTION

In one aspect, the claimed subject matter includes an apparatus to monitor properties of a solution to be used in an oilfield process including a flow loop in communication with a tank containing the solution, wherein the flow loop includes a pump, a viscometer and a densitometer. In one embodiment, the viscometer is configured to measure a viscosity of the solution and provide a viscosity output and the densitometer is configured to measure the density of the solution and provide a density output. In one embodiment, the apparatus includes a controller to receive the viscosity and density outputs and provide an operator interface terminal and system diagnostics, wherein the operator interface terminal is in communication with the controller and displays the viscosity and density outputs and system diagnostics.

In another aspect, the claimed subject matter includes a method to monitor properties of a solution to be used in an oilfield process, wherein the method includes communicating a tank containing the solution with a flow loop, wherein the flow loop comprises a pump, a viscometer, and a densitometer, pumping the solution from the tank through the flow loop, measuring a viscosity of the solution and outputting a viscosity reading with the viscometer, measuring the density of the solution and outputting a density reading with the densitometer, and evaluating the viscosity and density readings to determine the properties of the solution.

In another aspect, the claimed subject matter includes a method to inject a slurry into a subterranean formation, wherein the method includes measuring characteristic data from a well in communication with the subterranean formation, estimating downhole properties of the slurry using the measured characteristic data, measuring surface properties of the slurry with a measurement apparatus, determining optimal surface properties for the slurry from the estimated downhole properties, comparing the measured surface properties with the determined optimal surface properties, modifying the slurry until the measured surface properties are within tolerance values of the determined optimal surface properties, and injecting the modified slurry into the subterranean formation through the well.

Other aspects and advantages of the invention will be apparent from the following description and the appended claims.

DETAILED DESCRIPTION

Embodiments of the present disclosure include methods and apparatuses to monitor the properties of a solution to be used in an oilfield operation. More particularly, selected embodiments describe methods and apparatuses to monitor the properties of a waste re-injection slurry prior to and during an operation to inject that slurry into a subterranean formation.

Figure 1:
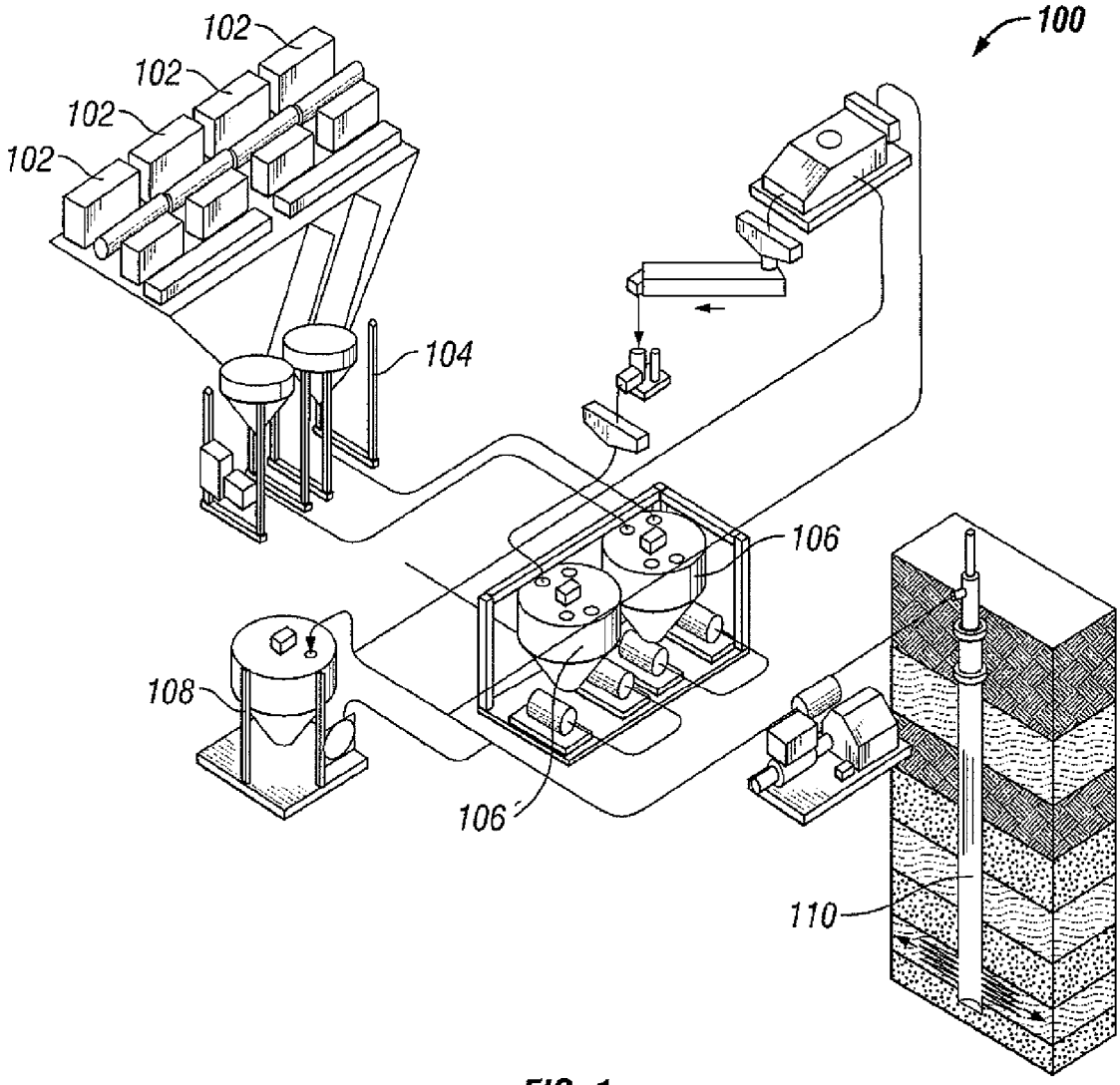
FIG. 1 is a perspective-view drawing of a re-injection system.

Referring initially to FIG. 1, an onshore cuttings re-injection site 100 is shown schematically. While re-injection site 100 is disclosed as an onshore system, it should be understood by one of ordinary skill that the systems described and disclosed herein are applicable to offshore, land-based, and remote (e.g., sub-sea, arctic, etc.) locations. In typical drilling operations, a mechanism 102 (e.g., one or more shale shaker screens) for removing solids and drill cuttings from the drilling fluid is provided. Next, the separated solids and cuttings are directed to a collection area 104. A mixing tank 106 is also provided, in which the slurry to be injected is prepared. The waste solids are transferred from collection area 104 to at least one mixing tank 106 where salt water, fresh water, oily drains, production water, other fluids, and other components may be mixed therewith to create an injectable slurry. As the slurry is prepared, it is transferred to a holding tank 108 before being injected. Alternatively, CRI operations may utilize two (or more) mixing tanks 106 and 106', wherein one tank 106 may prepare a slurry with coarse solids and the second mixing tank 106' may prepare a slurry with finer solids. Either of the two slurries or a controlled combination thereof may be transferred to holding tank 108 before being injected into a well 110.

Figure 2:
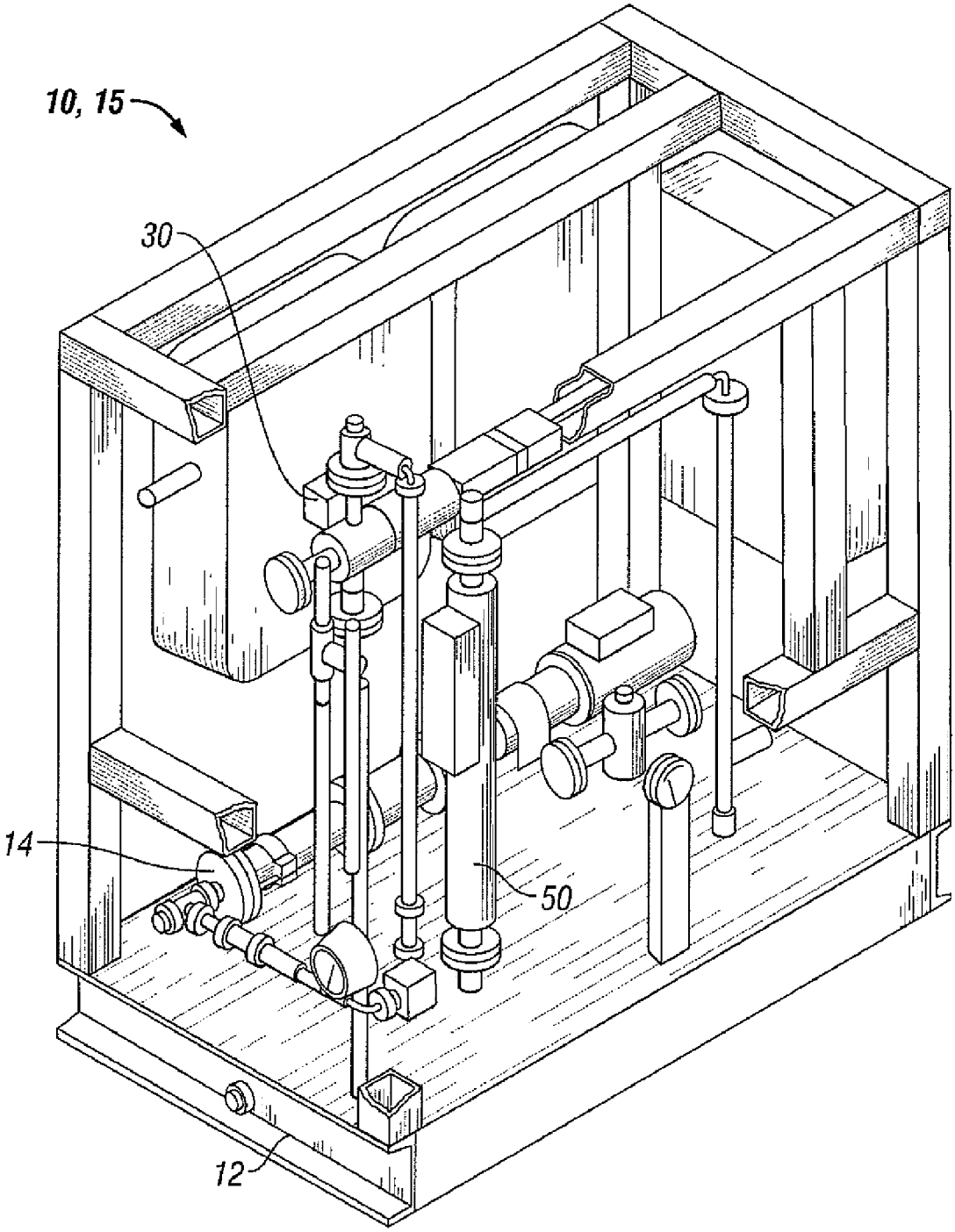
FIG. 2 is a perspective-view drawing of a skid-mounted monitoring system in accordance with embodiments of the present disclosure.

Referring now to FIG. 2, one embodiment relates to a skid-mounted monitoring apparatus 10 to monitor various properties of a waste re-injection slurry. It should be understood by one of ordinary skill, that while the term "skid-mounted" is used to describe apparatus 10, any configuration may be used. Particularly, the components of apparatus 10 may be confined to a single container (e.g., a skid) or may be spread out over a greater distance. Furthermore, apparatus 10 may be portable (i.e., moveable as a single unit), or may be configured in a more fixed, permanent configuration. As such, the physical size, configuration, and location of apparatus 10 is not to be limited by embodiments disclosed herein.

Figure 5:
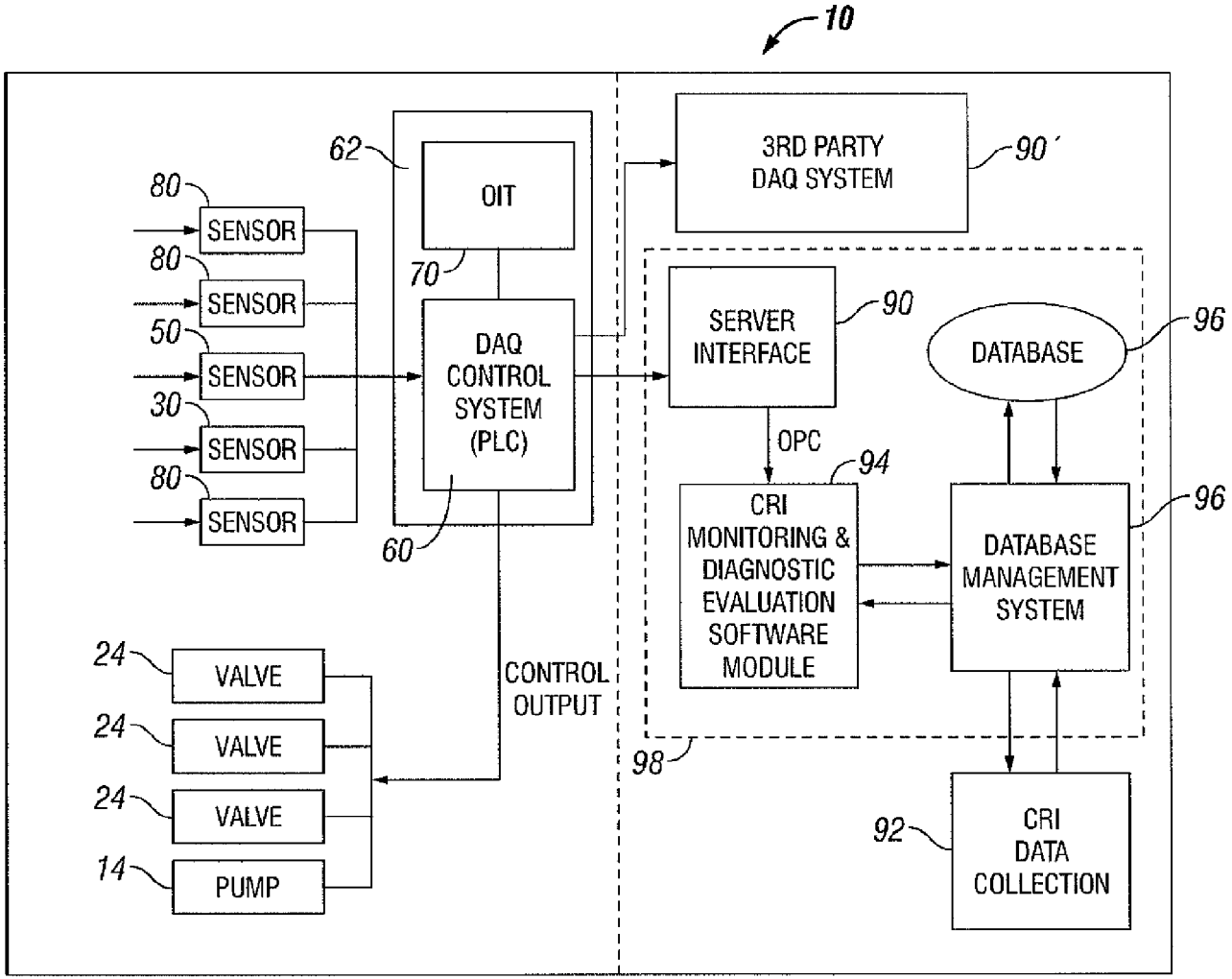
FIG. 5 is a block diagram of a re-injection monitoring system in accordance with embodiments of the present disclosure.

In this exemplary embodiment, the monitoring apparatus 10 depicted in FIG. 2 includes a skid 12 to which a pump 14, a viscometer 30, and a densitometer 50 are mounted. Referring briefly to FIG. 5, a data acquisition control system 60 and operator interface terminal (OIT) 70 may be housed in a control system enclosure 62 in digital communication with equipment on skid (12 of FIG. 2) and a plurality of sensors 80 located separately at the injection site. Optionally, in circumstances where monitoring apparatus 10 is located in a hazardous area, the OIT 70 may be remotely located and connected to remaining components on skid 12 via any networking or communication protocol known to one of skill in the art.

Figure 3:
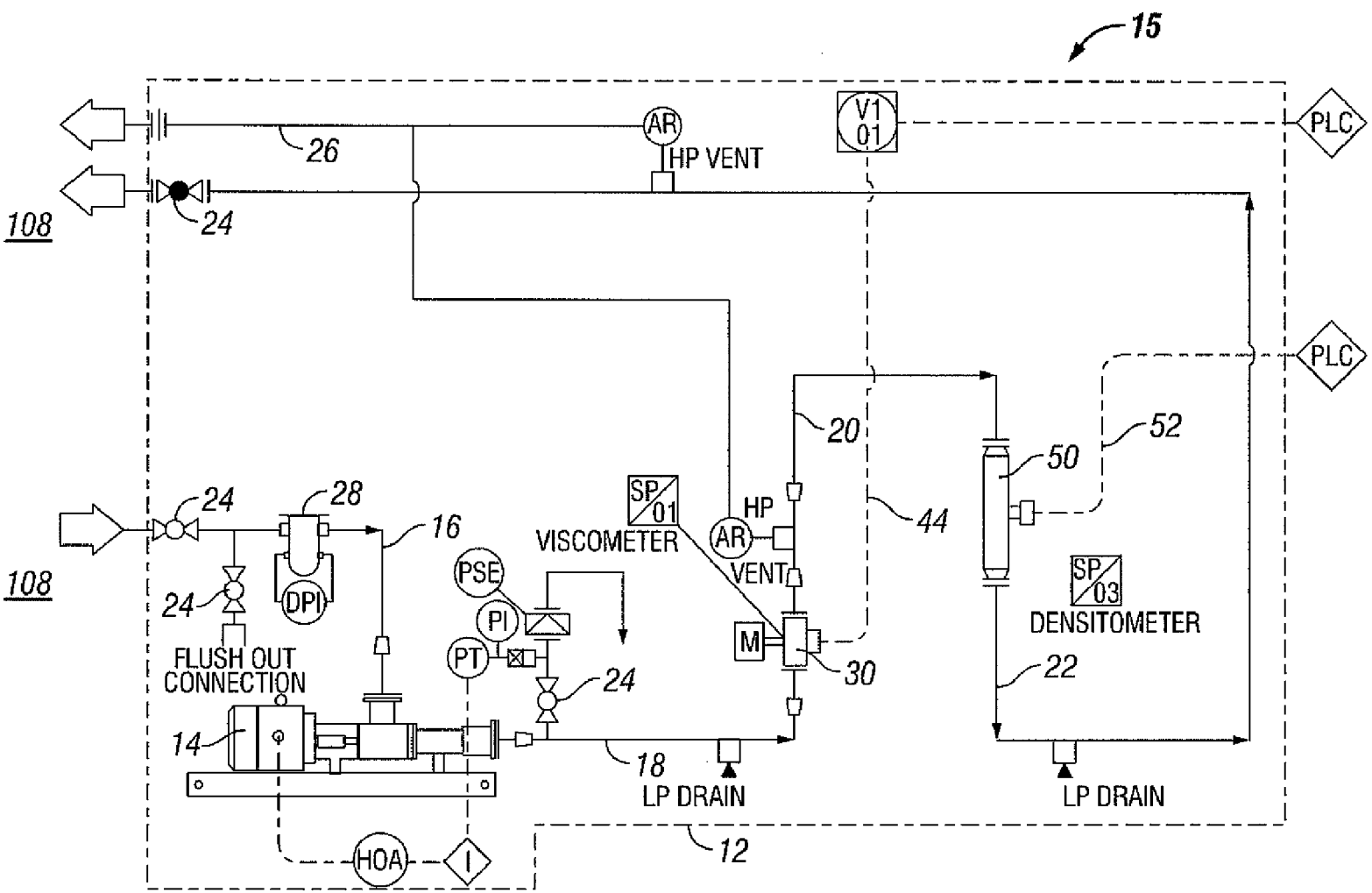
FIG. 3 is schematic layout of a flow loop in accordance with embodiments of the present disclosure.

Referring now to FIG. 3, characteristics of the slurry are measured by various components of monitoring apparatus 10. In one embodiment, skid 12 is positioned proximate to holding tank 108 in a location that minimizes the distance therebetween. Next, a viscometer 30 and a densitometer 50 of skid 12 are placed in fluid communication with the contents of holding tank 108. As the slurry in holding tank 108 is prepared, the slurry viscosity and density characteristics are measured by viscometer 30 and densitometer 50 and analyzed before injection into the well.

As shown schematically in FIG. 3, skid 12 comprises a flow loop 15 to circulate the slurry mixture from holding tank 108, through viscometer 30 and a densitometer 50. An optional second densitometer (not shown) in series with densitometer 50 may be used for redundant measurement of the slurry through flow loop 15. While flow loop 15 depicted in FIG. 3 includes a single viscometer 30 and a single densitometer 50, it should be understood by one of ordinary skill that any number of viscometers 30 or densitometers 50 may be used without departing from the scope of claims appended hereto.

As depicted in FIG. 3, flow loop 15 includes a plurality of lines 16, 18, 20, and 22, a plurality of valves 24. Furthermore, at least one vent line 26 may be included to connect components of the flow loop 15 (e.g., viscometer 30 and densitometer 50) to a vent line of holding tank 108. Alternatively, vent line 26 (if present) may be routed to an inlet of pump 14. While one particular arrangement of flow loop 15 is depicted in FIG. 3, it should be understood by one of ordinary skill that any number of combinations or configurations may be used to connect viscometers 30 and densitometers 50 to slurry holding tank 108. Generally, any combination of lines 16, 18, 20, and 22 may be used in conjunction with various valve 24 configurations to direct the slurry in holding tank 108 through viscometer 30 and densitometer 50.

Specifically, first line 16 communicates the slurry from holding tank 108 to pump 14, wherein pump 14 is configured to circulate the slurry through viscometer 30 and densitometer 50. Optionally, a strainer 28 may be located within first line 16 between holding tank 108 and pump 14. Second line 18 communicates the pressurized slurry from pump 14 to viscometer 30. Third line 20 communicates the slurry from viscometer 30 to densitometer 50. Finally, fourth line 22 returns the slurry from densitometer 50 to holding tank 108. At various locations within flow loop 15, several valves 24 are positioned to direct and restrict flow of the slurry through flow loop 15.

It should be understandable by one of ordinary skill that properties of the slurry will vary throughout the re-injection process and, thus, pump 14 may be selected to circulate a range of slurry viscosities and densities for extended periods of time. Further, as the slurry will, by its very nature, include particles of varying size and geometry, it is desirable for pump 14 to be durable enough to withstand wear and abrasion associated with pumping a slurry including such particles. Furthermore, in an effort to reduce damage to the measurement instruments, pump 14 may be configured to pump the slurry through densitometer 50 and viscometer 30 at reduced flow rates. These reduced flow rates may be dictated by physical limitations of the measurement instruments, or, they may be dictated by the type of measurement to be made. Thus, in one embodiment, a flow rate through flow loop 15 may be set not to exceed 20 gallons per minute. Furthermore, viscometer 30 is desirably positioned in close proximity to pump 14 along line 18 so that the distance through which the slurry must travel is minimized. Similarly, the pressure through line 18 may be controlled so that entrapped air is reduced. An excess of entrapped air may produce erroneous results or, in extreme cases, may damage flow loop 15 components.

Figure 4:
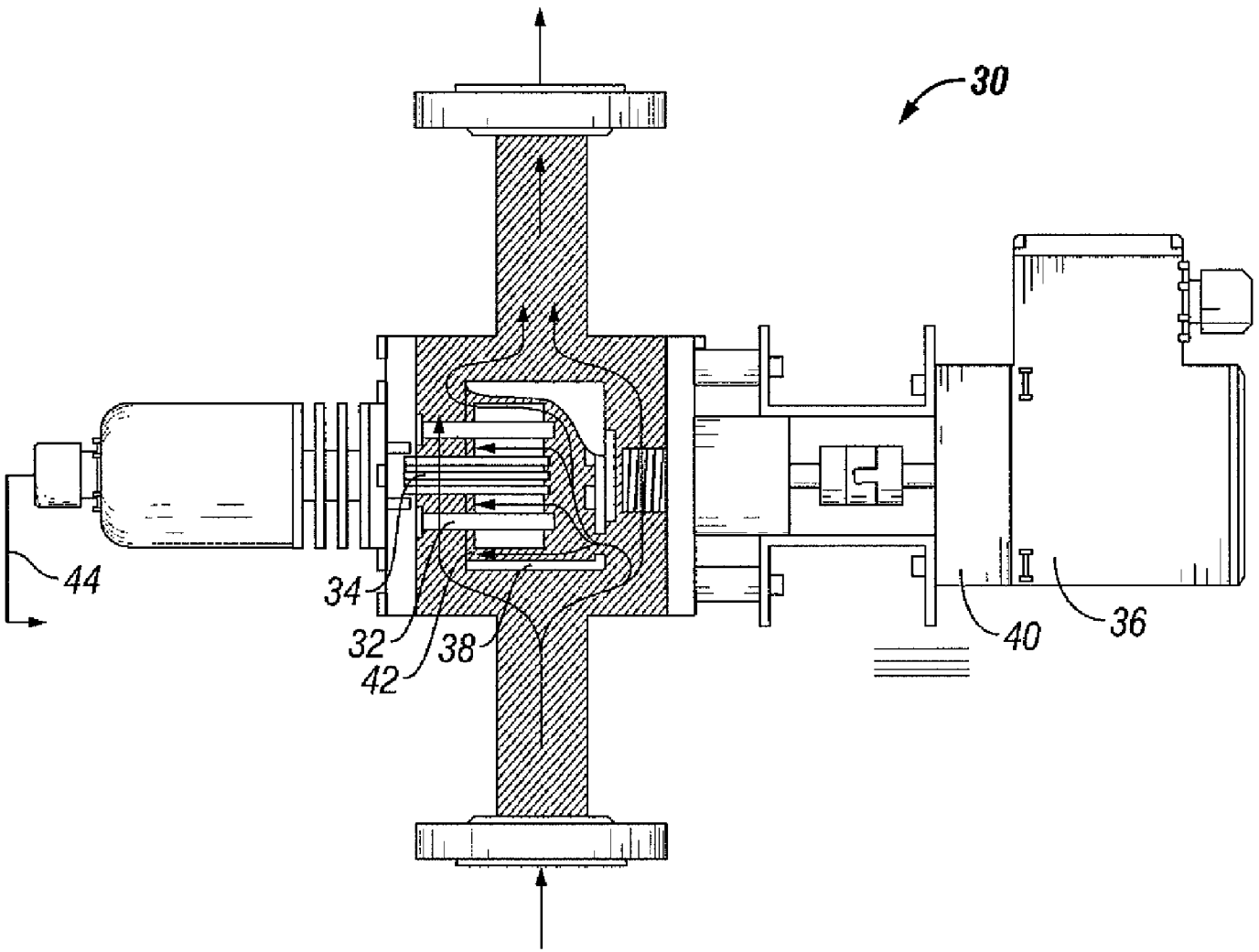
FIG. 4 is a cross sectional drawing of a viscometer in accordance with embodiments of the present disclosure.

Referring now to FIG. 4, viscometer 30 is shown constructed as a Couette-type viscometer employing a concentric cylinder geometry. While a Couette-type viscometer is shown for viscometer 30, it should be understood that any type of viscometer, including, but not limited to, vibrating fork viscometers, funnel viscometers, and tube pressure drop viscometers may be used without departing from the scope of the claims appended hereto. Furthermore, in circumstances where multiple viscometers 30 are used, different type viscometers 30 may be deployed so that any advantages and disadvantages of each type may be accounted and compensated for. In a Couette-type viscometer 30, an inner cylinder 32 is biased toward a preset position by a torsion element 34 located therein. A motor 36 provides rotation to a concentric outer cylinder 38 at a predetermined rotational velocity through a gear box 40. In operation, the slurry is directed into an annulus 42 formed between outer cylinder 38 and inner cylinder 32. As outer cylinder 38 is rotated, the slurry directed between inner cylinder 32 and outer cylinder 38 imparts a force to inner cylinder 32 causing rotational movement thereof.

The magnitude of the rotation imparted to inner cylinder 32 is a function of the resistive force of torsion element 34 and the viscosity of the slurry. Because the properties of torsion element 34 are known, the viscosity of the slurry may be determined. The measurement output of viscometer 30 is communicated through an output line 44 to data acquisition control system 60 (represented in FIG. 5) and operator interface terminal 70. It should be understood that such communication may be accomplished through any digital or analog communications protocol known to one of ordinary skill in the art. Furthermore, while it has been found that the viscosity of a slurry in an inline Couette-type viscometer 30 is more accurately measured when the rotational velocity of outer cylinder 38 is relatively slow, it should be understood that any of a range of speeds of outer cylinder 38 driven by motor 36 may be used. Particularly, the range of rotational velocity of outer cylinder 38 may be dictated by the physical constraints of the viscometer 30 used. Therefore, in one embodiment, the rotational velocity of outer cylinder 38 may be within the range of 0.1 to 60 revolutions per minute. While slow rotational speeds more accurately reflect the slow and no pumping conditions critical to CRI analysis, it should be understood by one of ordinary skill in the art that other, higher (or lower) may be used.

Because viscometer 30 is desirably mounted in close proximity with the equipment used to prepare and inject the slurry, and because the area in which the preparation and injection of the slurry takes place may be classified by relevant L standards as a hazardous area, viscometer 30 should be constructed as an explosion proof or intrinsically safe device as required by those standards. Both motor 36 and output line 44 utilize electrical current in some form, which may, in certain circumstances, become an ignition source. Thus, motor 36, the interface between viscometer 30 and output line 44, and output line 44 itself are preferably shielded, armored, and/or ventilated so as to meet requirements for local standards in hazardous areas.

Referring again to FIG. 3, at least one densitometer 50 is positioned such that it is in fluid communication with viscometer 30 through third line 20. While densitometer 50 is depicted as a vibrating tube densitometer, it should be understood that other types of densitometer including, but not limited to, vibrating fork devices, Coriolis-type mass flow devices, magnetic devices, and radioactive devices may be used without departing from the scope of the claims appended hereto. Furthermore, in circumstances where multiple densitometers 50 are used, different types of densitometers may be deployed so that any advantages and disadvantages of each type may be accounted and compensated for. Preferably, densitometer 50 is in close proximity to viscometer 30 so as to minimize the distance the slurry must travel in third line 20 between viscometer 30 and densitometer 50. As such, densitometer 50 operates to measure a flow density of the slurry and transmit data via an output line 52. As described above in reference to viscometer 30, it should be understood that such transmission may be accomplished by digital or analog communication through any of a variety of protocols. Furthermore, as mentioned above, an additional densitometer (not shown) may be provided in fluid communication with an outlet of densitometer 50. Second densitometer may not be required, but may be included to allow for built-in redundancy in the event densitometer 50 becomes inoperable. Preferably, densitometer 50 is safe for use in areas that are zoned as hazardous.

Several valves 24 are located within lines 16, 18, 20, and 22 of flow loop 15. Valves 24 may be manipulated by data acquisition control system 60 to control the pressure and flow rate of the slurry therethrough. Gases entrained in the slurry are compressed and may be released through vent line 26 to holding tank 108 for treatment and venting, thereby maintaining pressure required to achieve accurate readings from viscometer 30 and densitometer 50.

Referring to FIG. 5, control system 60 is shown housed within a control system enclosure 62 of monitoring apparatus 10. Control system enclosure 62 may also house operator interface terminal 70 where an operator is able to monitor and modify the performance of monitoring apparatus 10. Preferably, control system enclosure 62 is designed and constructed such that a sufficient amount of protection against exposure to drilling mud and other chemical agents is provided. It should be understood by one of ordinary skill, that while the control system 60 and enclosure 62 may be located within a hazardous area, operator interface terminal 70 may be located remotely, to an area outside the hazardous zone.

A plurality of remote sensors 80 are located at the injection site and are configured to measure and relay parameters including, but not limited to, flow rate, pump stroke, temperature, and pressure to control system 60. Alternatively, remote sensors 80 may include outputs from additional viscometers and densitometers, if present. Control system 60 interfaces with pump 14, valves 24, viscometer 30, and densitometer 50, and receives data measured therefrom in addition to data transmitted by sensors 80. As previously discussed, it may be necessary to modify the pressure and/or flow rate of the slurry through flow loop 15 in order to obtain more accurate readings. As such, control system 60 may interface with and actuate pump 14 and valves 24 to regulate the flow of slurry through lines 16, 18, 20, and 22 of flow loop 15 to achieve the desired pressure and/or flow rate. Furthermore, parameters of the measurement devices, including, but not limited to, the rotational speed of outer cylinder 38 of viscometer 30 may be controlled. When desired, control system 60 may open and close individual valves 24 in concert with switching pump 14 off and on to purge and drain the components and lines of flow loop 15 for maintenance. Furthermore, valves 24 may be similarly manipulated to allow for rinsing or flushing of flow loop 15 with water or oil based fluids. Optionally, these operations may be performed automatically by the control system 60 based upon measurements provided from sensors 80 or from viscometer 30 and densitometer 50. Alternatively, these operations may be performed manually either through an interface of control system 60 or by turning valves 24 installed in flow loop 15.

Operator interface terminal 70 may display internal diagnostics of control system 60 including, but not limited to, current values and warning flags from remote sensors 80, viscometer 30, and densitometer 50. It is contemplated that an operator may view real-time input values for parameters including well pressure, head pressure, pump stroke rate, slurry density, and slurry viscosity. Furthermore, the operator may view any or all input and output values, the status of the inputs and outputs, alarms, and controller health indicators from the operator interface terminal 70. Additionally, troubleshooting and help information may also be provided to the user at the operator interface terminal 70. As operator interface terminal 70 may be positioned on or near control system enclosure, it may be remotely located outside a hazardous area such that an operator may view and interact with it without having to enter the hazardous area. Additionally, when operator interface terminal 70 is located in an outdoor area, an adjustable sun visor (not shown) may be provided to remove glare from the display screen (not shown).

In circumstances where remote monitoring of the cuttings re-injection operation is desired, data may be transmitted from control system 60 via a server interface 90 to a location away from both flow loop 15 and control system enclosure 62. In some circumstances, remote monitoring is desired because the flow loop 15 is located in a hazardous zone. In other circumstances, a single remote location is used to monitor several flow loops 15 of various cutting re-injection locations. Such a server interface 90 may be a personal computer or a processing device (e.g., a programmable logic controller) including a software application operable to receive data from control system 60 and provide the data in a format readable by the operator.

Further, a cuttings re-injection monitoring and diagnostic evaluation software module 94 may monitor parameters being measured by sensors 80, viscometer 30, densitometer 50, at holding tank 108, and at the well. Alarms may be initiated by the software module when measured values and/or derived parameters based on measured values fall below or rise above predetermined values or when a trend in the measured values and/or derived parameters indicates a potential issue. Furthermore, software module 94 may be in communication with a database 96 containing historical values and/or maximum and minimum values for such parameters monitored by software module 94. While FIG. 5 shows server interface 90, software module 94, and database 96 be contained within a single device 98, it should be understood that separate devices connected by a communications network may also be used.

Alternatively, a remote operator interface 90' may include a third party data acquisition system similar to that already in use by the operator. In this circumstance, control system 60 communicates data from sensors 80, viscometer 30, and densitometer 50 to remote operator interface 90'. Based upon the data provided, the operator may decide either to continue injecting the slurry having the properties measured or to modify the slurry in mixing tank 106 and/or holding tank 108 through the addition of solids, fluids, and additives.

Figure 6:
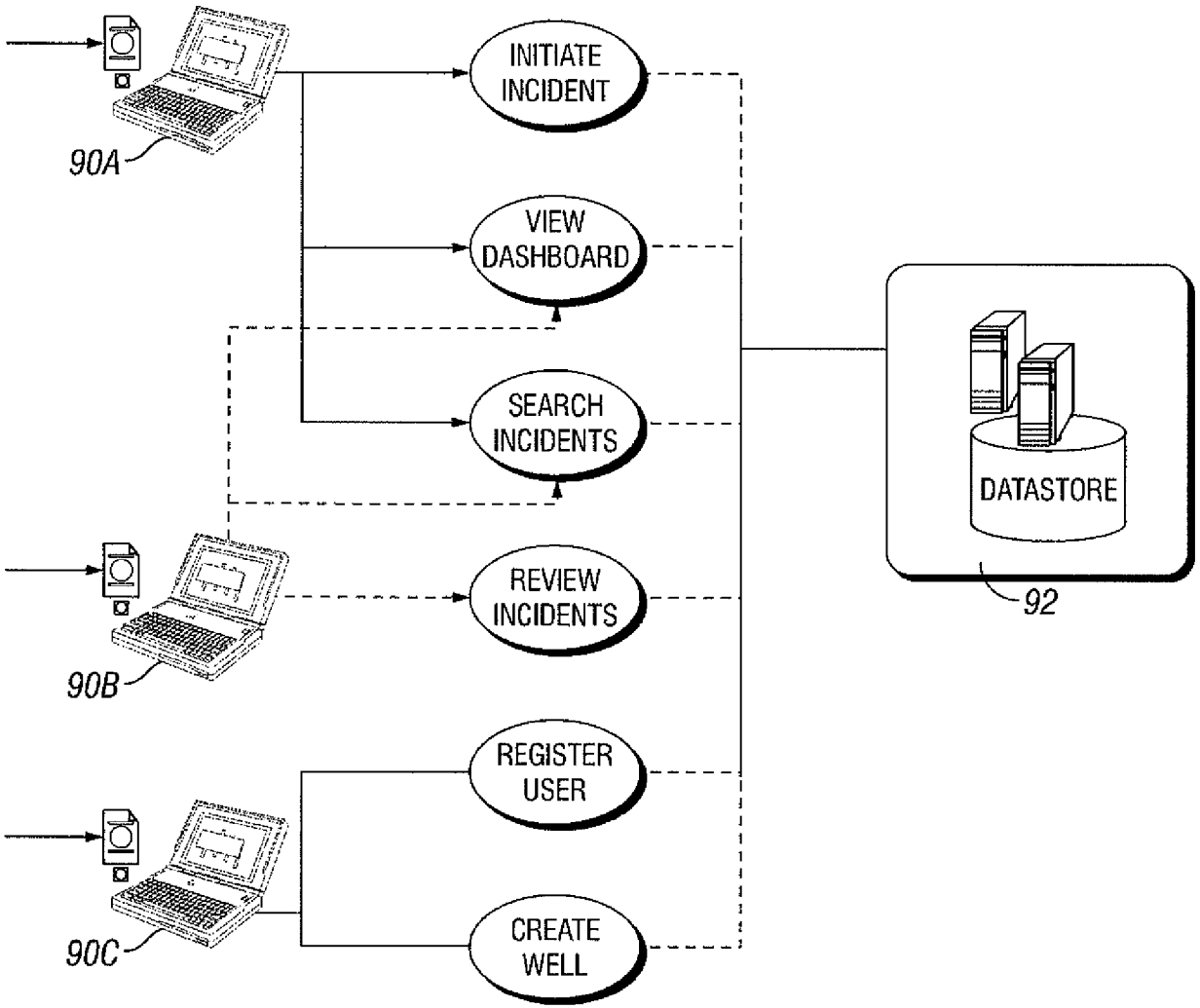
FIG. 6 is a schematic layout of a data management process in accordance with embodiments of the present disclosure.

Referring now to FIGS. 5 and 6, data collected from a particular re-injection site (e.g., 100 of FIG. 1) may be transmitted to a centralized data collection location 92. This data transmission may be initiated by any of a variety of automatic or manual methods including, but not limited to, input by on-rig personnel, predetermined time schedules, accrued data quantity schedules, or by events triggered upon the diagnostic software configured to detect combinations of parameter values. As data is collected from various remote sites, it is loaded into a database management system for future reference. The data from any particular site may be reviewed by remote operator interfaces located at a re-injection site 90A, at a support center 90B, or at an administration location 90C. Alternatively, data collected at a particular injection site may be transmitted directly to the centralized data collection area 92. The data from a plurality of injection wells is collected and tabulated in the centralized data collection area 92.

Analysis is performed on the collected data to develop profiles of different types of slurries used in various types of injection wells. The centralized data collection area 92 may include a secure administrative database. Using data provided by operators, potential risks may be identified at a single injection site based on deviation of measured parameters from control limits established from data collected from sites having comparable characteristics. In addition, advisories regarding preferred slurry characteristics may be made to the operator of a particular re-injection site based upon the comparison of that site's data to comparable data in centralized data collection area 92. It is contemplated that data may be transmitted in real time to the centralized data collection area 92 for such analysis. The operator may then decide whether to inject the slurry having the current characteristics or return the slurry to mixing tank 106 or 106' for modification of the slurry prior to injection.

In an alternative embodiment, monitoring apparatus 10 is used to monitor the slurry in one of the mixing tanks 106 or 106'. In this embodiment, the properties of the slurry are monitored as it is prepared. Based on the properties measured, additional solids or liquids may be added to the slurry until it exhibits the desired characteristics. The addition of solids, liquids, and/or additives may be automated, based on values obtained from the monitoring apparatus 10. Manual control of the addition of slurry materials may be exclusive or shared with automated controls.

In another alternative embodiment, a first monitoring apparatus 10 monitors the slurry in holding tank 108 while a second monitoring apparatus (not shown) monitors the slurry being prepared in mixing tanks 106 or 106'. While systems in accordance with this embodiment require two monitoring apparatuses, they advantageously provide real-time data of the slurry both immediately prior to injection to the well and while still in mixing tank 106 or 106'. Such a monitoring system allows the slurry composition to be modified and monitored at the same time.

In another alternative embodiment, a first monitoring apparatus 10 is used to monitor the slurry in holding tank 108, a second monitoring apparatus (not shown) is used to monitor the slurry being prepared in first mixing tank 106, and a third monitoring apparatus (not shown) is used to monitor the slurry being prepared in second mixing tank 106'. In this embodiment, three monitoring apparatuses are used. As described above, real-time data pertaining to the slurry immediately prior to injection to the well is collected. Also, data at two mixing tanks 106 and 106' may be used to determine whether, and to what extent, slurry characteristics should be manipulated by the addition of fluids, solids, and/or additives.

Additionally, the embodiments described herein may be used in conjunction with a slurry simulator to predict and/or measure the performance of a downhole cuttings re-injection operation so that real-time adjustments may be made to optimize the operation. Numerous variables, including, but not limited to, slurry temperature, slurry viscosity, slurry density, slurry particle size, injection pressure, injection flow rate, particle settling, borehole trajectory, and borehole geometry may affect the success and feasibility of a CRI operation. Particularly, in smaller boreholes in substantially horizontal trajectories, solids may rapidly accumulate at the bottom of the borehole and "stall" the re-injection operation. As a stalled condition may require remedial well intervention to be corrected, such stalling of the re-injection operation would be extremely costly. Furthermore, in circumstances where it is not feasible to measure certain variables (e.g., the temperature, and viscosity of the slurry downhole), the slurry simulator may be configured to estimate these values as a function of variables that are measurable (e.g., temperature and viscosity of the slurry at the surface, and the depth of the borehole). Therefore, in using a slurry simulator, various downhole conditions may be estimated and simulated to assist in modeling an "optimized" slurry that is more effectively injected downhole. Once such a model is created, the actual slurry may be measured and modified prior to injection to approximate the optimized model.

Of particular interest, a slurry simulator may be used to estimate the bottom-hole pressure as a function of time for a particular slurry. Often, CRI operations are performed in batches, whereby an amount of slurry is injected and the operation is paused when a predetermined pressure or amount of injected solution is reached. As time passes, the downhole properties, including the bottom-hole pressure of the slurry change until a stabilization point is reached. Once the stabilization point is reached, the CRI operation may continue to allow another amount of slurry to be injected into the formation. As the time to reach this stabilization point varies by slurry composition and wellbore properties, the ability to estimate the bottom-hole pressure and stabilization time of an injected slurry is of great benefit. Furthermore, through data analysis algorithms and historical methods, the slurry simulator may be capable of determining the bottom-hole pressure of an injected slurry as a function of properties (i.e., surface temperature and pressure) that are directly measurable. Using such analytical methods, a slurry simulator may be capable of outputting a real-time plot of bottom-hole pressure as a function of time for a particular re-injection well. As such, an operator of a CRI process can use such a plot to determine how large of a batch of slurry may be injected next, and when that injection may take place.

The slurry simulator may be either an analytical process or an apparatus capable of predicting the downhole behavior of the slurry. As such, the simulator may be based upon mathematical models (e.g., finite element analysis), a database of historical well data (e.g., as described above in reference to FIGS. 5 and 6), or any other means for predicting performance. One slurry simulator that may be used in conjunction with embodiments of the present disclosure is described in U.S. patent application Ser. No. 11/073,448 entitled "Apparatus for Slurry Operation and Design in Cuttings Re-Injection" filed on Mar. 7, 2005 by Quanxin Guo and Thomas Geehan, hereby incorporated by reference in its entirety herein.

In using a slurry simulator, known values for certain variables are inputted so that unknown variables may be calculated or estimated. From these calculations, parameters for a theoretically optimal slurry are calculated. Next, using a measurement apparatus (e.g. apparatus 10 and flow loop 15 of FIGS. 1-6), the state of the current slurry may be measured and compared with the optimal model to determine if the slurry may be modified to more closely approximate (i.e., fall within tolerances of) the optimal model. If changes are made, the measurement apparatus may again be used to verify the slurry composition before it is injected downhole.

Desirably, slurry simulator and measurement apparatus are operated in real-time in conjunction with one another to not only create an optimal slurry composition at the beginning of a CRI operation, but also to continuously re-evaluate the needs of the injected slurry and tweak its composition throughout the entire life of the CRI operation. Furthermore, while a single device may perform all the tasks of estimating, calculating, and optimizing, it should be understood that several devices may be used in conjunction with one another to accomplish the same goal. Additionally, it should be understood that as the properties of the injected slurry will certainly change as it is injected downhole, the slurry simulator may account for changes in slurry properties downhole when calculating the desired composition of slurry before injection.

Figure 7:
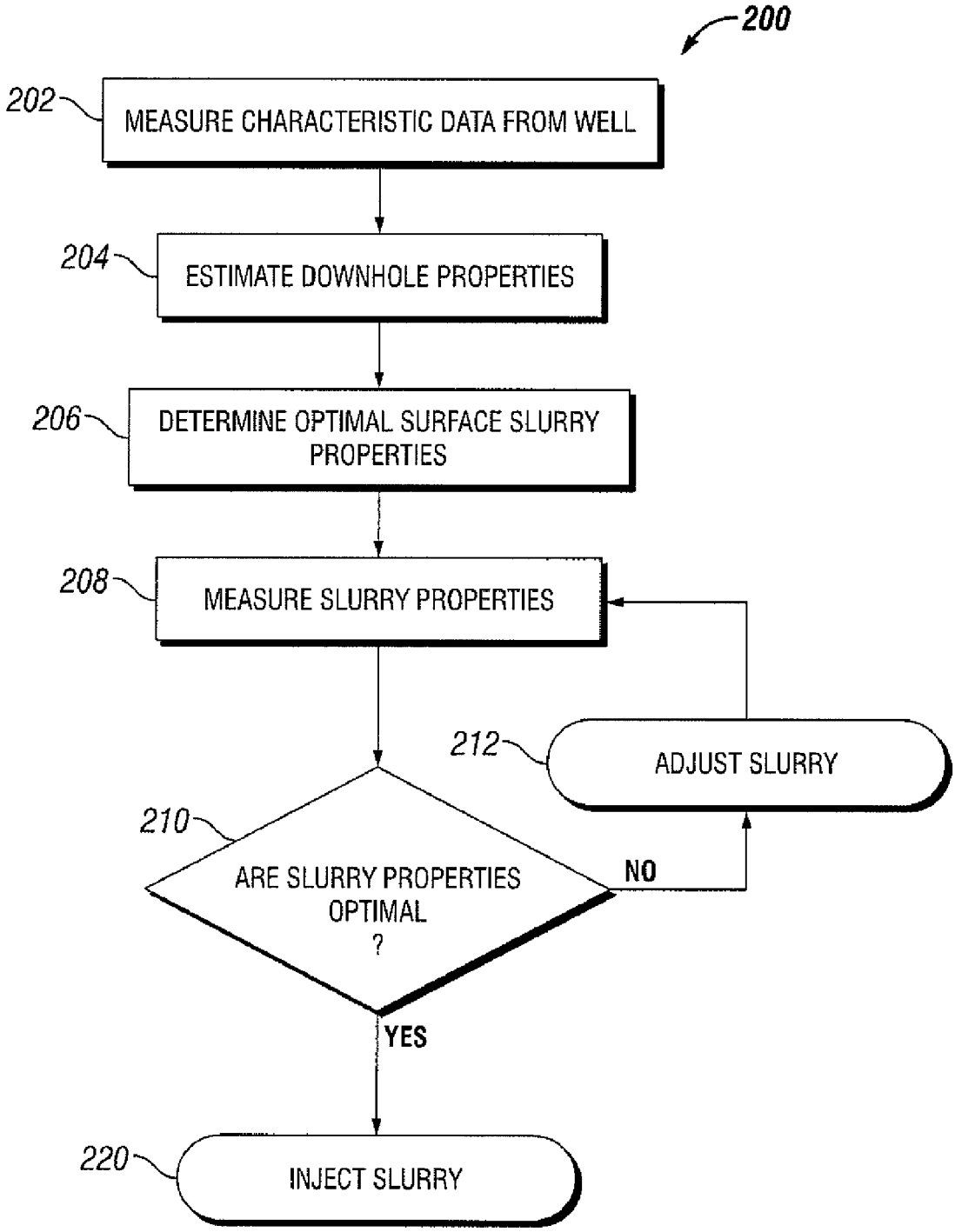
FIG. 7 is a block diagram of a re-injection method in accordance with embodiments of the present disclosure.

Referring now to FIG. 7, a slurry injection method 200 is shown schematically. Preferably, slurry injection method 200 begins with the measurement of characteristic data from the well 202. Next, properties of the formation and/or slurry that are not directly measurable are estimated or calculated 204. For example, to calculate the temperature and pressure of the downhole formation and/or slurry, the measurable temperatures and pressures of a slurry or drilling fluid as it enters and exits the wellbore may be recorded. These differential pressure and temperature values may be used in conjunction with additional known or measurable quantities (e.g., well depth and temperature of the formation) to calculate the pressure and temperature of the slurry in the formation downhole.

Next, the slurry simulator uses the measured well characteristics in addition to the estimated and calculated downhole properties to determine the properties for an optimal slurry 206. Next, the current properties of the slurry are measured 208 using a measurement apparatus (e.g., apparatus 10 and flow loop 15). If the measured slurry properties are within tolerances of the optimized slurry as determined by the slurry simulator 210, the re-injection operation proceeds to inject the slurry 220. If the measured slurry properties are outside of the optimized slurry tolerances 210, the slurry is adjusted 212 and the measurement 208 and comparison steps 210 are repeated. Once brought within the tolerances of the optimal slurry, the slurry simulator may be continuously used to monitor the measured characteristic data and the surface slurry properties to make adjustments for changes in either the downhole formation properties or the surface slurry composition. Depending on the complexity of the slurry simulator and/or user interface, the slurry simulator may simply output an indication of "go/no-go" for the measured slurry or may output a complex graphical representation showing the where the slurry properties lie within the tolerance band.

Advantageously, embodiments described by the present disclosure allow for cuttings re-injection operations to be monitored and optimized for various configurations and types of re-injection wellbores. Using embodiments of the present disclosure, properties of waste and cuttings slurries can be monitored, modified, and optimized so that their re-injection into the formations can proceed as efficiently and cost effectively as possible. As a further advantage, a single slurry simulator may be capable of optimizing the slurry composition for several re-injection locations. As such, a single slurry simulator connected to various wellbore locations through a communications network may configure and optimize numerous re-injection wells with a minimal need for human presence in hazardous zones.

While the claimed subject matter has been described with respect to a limited number of embodiments, those skilled in the art, having benefit of this disclosure, will appreciate that other embodiments can be devised which do not depart from the scope of the claimed subject matter as disclosed herein. For example, monitoring apparatus 10 may be used to monitor drilling fluids prepared for and used in a drilling operation. Accordingly, the scope of the claimed subject matter should be limited only by the attached claims.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method to inject a slurry into a subterranean formation, the method comprising:

measuring at least one of flow rate, pump stroke, temperature, and well pressure, head pressure, slurry viscosity and slurry density at an injection well in communication with the subterranean formation;

estimating downhole properties of the slurry using the measured data;

measuring surface properties of the slurry with a measurement apparatus;

modeling surface properties for the slurry from the estimated downhole properties;

comparing the measured surface properties with the determined modeled surface properties;

modifying the slurry until the measured surface properties are within determined tolerance values of the determined modeled surface properties; and injecting the modified slurry into the subterranean formation through the well, wherein the estimated downhole properties of the slurry comprise bottom-hole pressure and slurry stabilization time.

2. The method of claim 1, wherein the estimating and modeling steps are performed by a slurry simulator.

3. The method of claim 1, wherein the measured surface properties of the slurry comprise viscosity and density.

4. The method of claim 1, wherein the measurement apparatus comprises:

a flow loop in communication with a tank containing the slurry, the flow loop comprising a viscometer and a densitometer; and a controller to receive viscosity and density readings from the viscometer and densitometer.

5. The method of claim 4, wherein the measurement apparatus further comprises an operator interface terminal in communication with the controller to display the viscosity readings, the density readings, and system diagnostics data.

6. A method to inject a slurry into a subterranean formation, the method comprising:

measuring at least one of flow rate, pump stroke, temperature, and well pressure, head pressure, slurry viscosity and slurry density at an injection well in communication with the subterranean formation;

estimating downhole properties of the slurry using the measured data;

measuring a surface viscosity of the slurry with a viscometer;

measuring a surface density of the slurry with a densitometer;

modeling surface viscosity and surface density of the slurry from the estimated downhole properties;

comparing the measured surface viscosity and the measured surface density with the modeled surface viscosity and the modeled surface density;

modifying the slurry until the measured surface viscosity and the measured surface density are within determined tolerance values of the modeled surface viscosity and the modeled surface density; and injecting the modified slurry into the subterranean formation through the well, wherein the estimated downhole properties of the slurry comprise bottom-hole pressure and slurry stabilization time.

7. The method of claim 6, wherein the estimating and modeling steps are performed by a slurry simulator.

* * * * *